United States Patent [19]

Lange et al.

[11] 4,366,412

[45] Dec. 28, 1982

[54] SURGE ARRESTER WITH PARALLEL-CONNECTED IMPROVED SPARK GAP STRUCTURE

[75] Inventors: Gerhard Lange; Oskar Sippekamp, both of Berlin; Gerhard Schwenda, Vincenzenbronn, all of Fed. Rep. of Germany

[73] Assignee: Siemens Aktiengesellschaft, Berlin and Munich, Fed. Rep. of Germany

[21] Appl. No.: 156,413

[22] Filed: Aug. 4, 1980

[30] Foreign Application Priority Data

Dec. 20, 1979 [DE] Fed. Rep. of Germany ..... 2951467

[51] Int. Cl.[3] ..... H01J 17/00; H01J 21/00

[52] U.S. Cl. ..... 313/325; 315/32; 361/120; 361/124; 361/129

[58] Field of Search ..... 313/325; 361/120, 124, 361/128, 129; 315/32, 35

[56] References Cited

U.S. PATENT DOCUMENTS

| | | | |
|---|---|---|---|
| Re. 30,724 | 8/1981 | Klayum et al. | 361/124 |
| 4,002,952 | 1/1977 | Menninga | 361/124 |
| 4,041,543 | 8/1977 | Pasculle et al. | 361/124 |
| 4,132,915 | 1/1979 | Wilms | 313/325 |
| 4,158,869 | 6/1979 | Gilberts | 361/120 |
| 4,320,435 | 3/1982 | Jones | 361/120 |
| 4,321,649 | 3/1982 | Gilberts | 361/124 |

*Primary Examiner*—Saxfield Chatmon, Jr.
*Attorney, Agent, or Firm*—Hill, Van Santen, Steadman, Chiara & Simpson

[57] ABSTRACT

A surge arrester with a parallel-connected improved spark gap structure has a flanged ring connected to one of the two electrodes of the surge arrester which forms the first electrode of the spark gap structure, an axially aligned insulator disc having recesses therein seated on the flanged ring, and an annular metal contact seated on the opposite side of the insulator ring forming the second electrode of the spark gap structure through the recesses in the insulating ring has the improvements of the metal contact forming the second electrode of the spark gap being an annular cup having a base seated against the insulator ring and a conical wall connected via contact springs with the other electrode of the surge arrester, and the base of the annular cup has projections in registry with the insulator ring recesses extending a distance therein such that the spark gap is formed between the flanged ring and the highest elevation of the projections. The spark gap serves as a back up to a fail-safe device which would normally permanently short the surge arrester to ground after an extended discharge, which spark gap is resistant to conductive deposits being formed thereon.

12 Claims, 1 Drawing Figure

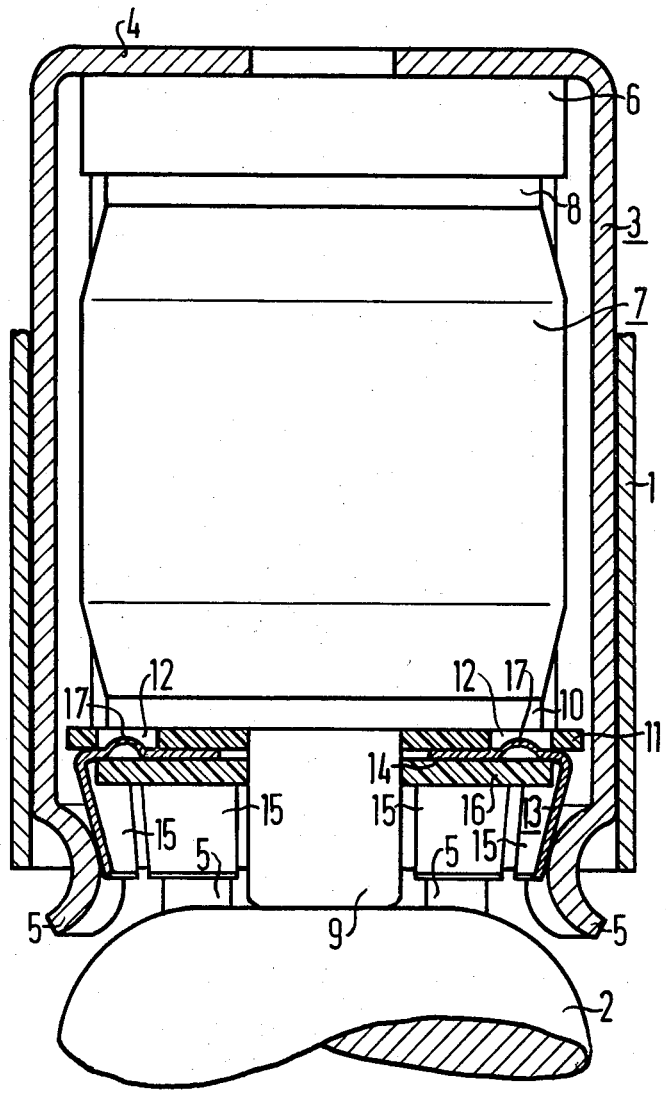
4
6
8
3
7
1
12
17
12
17
10
11
14
15
15
15
16
13
15
5
5
5
5
9
2

SURGE ARRESTER WITH PARALLEL-CONNECTED IMPROVED SPARK GAP STRUCTURE

BACKGROUND OF THE INVENTION

1. Field of the Invention

The present invention relates to a surge arrester having a fail-safe structure for permanently shorting the arrester to ground after an extended discharge and in particular to such a device having an improved spark gap structure as a back up to the fail-safe device.

2. Description of the Prior Art

A spark gap protector utilizing a gas tube spark gap device and a spring actuated fail-safe device for permanently shorting the spark gap protector to ground after an extended discharge is known, for example, from U.S. Pat. No. 4,132,915 and the corresponding German OS No. 27 40 695. As disclosed therein, the gas tube spark gap device has a flanged ring connected to one of its two electrodes which forms the first electrode of an auxiliary spark gap structure, an insulating ring having two apertures therein which is seated on a face of the flanged ring, and an annular metal element disposed on the opposite side of the insulator ring which forms the second electrode of the auxiliary spark gap structure through the apertures in the insulator ring. The second electrode of the auxiliary spark gap structure is further connected via contact springs with the other electrode of the gas tube spark gap device. The teachings of U.S. Pat. No. 4,132,915 are incorporated herein by reference.

Within the gas tube spark gap device is a solder pellet which is melted upon an extended discharge of high voltage permitting a bias spring to urge the housing containing the gas tube spark gap device into a permanently shorted fail-safe condition. For proper operation thereof, the gas tube spark gap device must remain sealed, and in the event of a fracture to the gas tube structure the auxiliary spark gap structure provides a back up protection at a breakdown voltage which is larger than the breakdown voltage ordinarily associated with the gas tube spark gap device.

This structure of a gas discharge surge arrester in parallel connection with the auxiliary spark gap structure is particularly suited for the protection of telephone installations against surge voltages.

The above-described known combination of a gas discharge surge arrester with an auxiliary spark gap structure has the disadvantage that the air gap within the auxiliary spark gap structure is approximately 0.1 mm which is defined and limited by the thickness of the insulating ring. For reasons well known to those skilled in the art, discharges within the gap tend to occur at the edge of the apertures in the insulator ring, and after a number of such discharges a conductive coating is generated on the surface of the insulator ring at the aperture edges thereby reducing the insullation capabilities in that region. The load capacity and proper operation of the entire structure are thereby diminished due to the increased conductivity between the two electrodes of the spark gap structure.

SUMMARY OF THE INVENTION

It is an object of the present invention to provide a surge arrester with a parallelly connected auxiliary spark gap structure of the type described above in which the spark gap structure is improved to minimize deposit of conductive material thereon and which has a relatively simple and inexpensive structure which may be adapted to housings already in existence.

In a surge current protector of the type described above having a surge arrester device with a parallelly connected spark gap structure, the above objects are inventively achieved by the following improvements. The annular metal element which forms the second electrode of the auxiliary spark gap structure is in the form of an annular cup having a base which is seated against the insulator ring and has a conical wall with an exterior which rests against contact springs connected to the other electrode of the surge arrester device.

On the base of the annular cup, in registry with the recesses in the insulator ring, the metal base has a plurality of projections extending a distance into the recesses in the insulator ring such that discharges within the spark gap will always occur between the point of highest elevation on the projection and the first electrode of the auxiliary spark gap structure which is formed by the flanged ring seated on the surge arrester.

By selected extension of the projections within the recesses in the insulating ring, the spark gap can be precisely set to accommodate voltage surges within a predetermined range. The thickness of the insulator ring disc can thus be increased to a multiple of the distance of the air gap. The walls of the recesses are thereby not vitiated as a result of the discharges, because the discharges only occur at the peaks of the projections. In a preferred embodiment, the projections are hemispherical in shape. The auxiliary spark gap structure and the surge arrester are rigidly connected to one another, so that installation in existing mounts, for example at residential service connections, is facilitated.

In a further embodiment of the invention, the insulator ring and the two spark gap electrodes are axially aligned and surround a solid contact cylinder which connects one electrode of the surge arrester to an exterior connection.

The annular metal cup is maintained in its position by means of an annular fastening disc abutting the base of the cup, so that the spark gap can be formed within specified tolerances. The fastening disc may consist of insulating material and is secured by means of a press fit on the contact cylinder which extends through the fastening disc as well as the other contact parts.

In a preferred embodiment, the insulator ring has four uniformly spaced recesses distributed on a circle having a diameter less than the diameter of the insulator ring and the annular metal cup accordingly has four projections in registry with the recesses. Four spark gap structures are thereby connected in parallel to the surge arrester.

The wall of the annular cup which forms the second electrode of the auxiliary spark gap structure may be divided by a plurality of axially extending slots so that a corresponding number of resilient contacts are formed against which the contact springs of the surge arrester holder abut. The contacts formed by the slots may proceed slightly inwardly so that the annular wall of the cup is in the form of a truncated cone. The overall length of the entire structure is thereby minimized. Moreover, the contact springs may serve as a centering device for centering the structure in a tubular mount. The divided wall of the annular cup can further serve to center the surge arrester in the contact spring holder and also serves to maintain an insulating interval between the contact spring holder and the surge arrester.

DESCRIPTION OF THE DRAWING

The single FIGURE is a side view, partly in section of a surge arrester having a parallelly connected auxiliary spark gap structure constructed in accordance with the principles of the present invention.

DESCRIPTION OF THE PREFERRED EMBODIMENTS

A surge arrester with an auxiliary spark gap structure connected in parallel is shown in the FIGURE. A portion of the housing or mount which surrounds the structure is referenced at 1. The portion of the housing 1 which is not shown in the FIGURE would extend above the interior components. An external contact is shown at 2, which has a generally flattened hemispherical shape. A contact spring holder 3 is disposed within the housing 1 and is in sliding engagement with the walls of the housing 1.

The contact spring holder 3 has a flat face 4 disposed at one end thereof and a plurality of curved contact springs 5 extending axially from an opposite end thereof. The housing 1 and the contact spring holder 3 are both cylindrical with the contact spring holder 3 having a smaller diameter than the housing 1. The contact springs 5 press against the interior wall of the contact spring holder 3, thereby aiding in the centering of the holder 3 within the housing 1.

A soft solder disc 6 is seated against the interior of the face 4 within the holder 3, and is also seated against an outer electrode terminal 8 of a gas discharge surge arrester 7, also disposed within the holder 3. The surge arrester may be of the type described in U.S. Pat. No. 4,132,915, or any other suitable surge arrester known to those skilled in the art. The other outer electrode terminal of the surge arrester 7 is in the form of a solid contact cylinder 9 which axially abuts the outer contact piece 2. The contact spring holder 3 and the internal components contained therein are urged in the direction of the outer contact piece 2 by a bias spring (now shown) so that the surge arrester 7 and the soft solder disc 6 are normally maintained in contact. The bias spring may be disposed in the manner shown in U.S. Pat. No. 4,132,915 against the face 4 of the holder 3.

The soft solder disc 6 in combination with the contact springs 5 and the biased spring guarantee so called fail-safe operation of the structure. After a surge voltage of sufficient magnitude such that the soft solder layer 6 is heated to its melting point by the dissipated energy of the surge arrester 7, the bias spring pushes the contact spring holder 3, and the contact springs 5, against the contact piece 2. The holder 3 is connected to ground, so that the contact piece 2 is short-circuited to ground potential after the high surge voltage.

The surge arrester 7, if it is of a gas discharge type, can only function as long as it remains hermetically sealed, and in the event that such seal is broken, surge voltages which would ordinarily be high enough to melt the soft solder disc 6 can pass through the arrester 7 without creating sufficient energy to raise the solder disc 6 to its melting point. As a back up, an auxiliary spark gap structure is provided as described in detail below.

The surge arrester 7 has a flanged ring 10 which receives and surrounds the contact piece 9 and forms a part of one of the electrodes of the surge arrester 7, as well as forming the first electrode of the auxiliary spark gap. An insulator ring disc 11, consisting of ceramic or synthetic material, is disposed in axial registry against the flanged ring 10. The insulator ring 11 has four recesses 12 extending therethrough which are uniformly distributed in spaced relation on a circle within the insulator ring 11. Two of the recesses 12 are visible in the FIGURE. An annular metal cup 13 having a base 14 and an annular side wall is disposed on the opposite side of the insulator ring 11 and is axially aligned with the ring 11 and the contact cylinder 9, however, the cup 13 does not touch the contact cylinder 9. The side wall of the cup 13 is divided into eight segments, each forming a contact 15 by axial slots in the wall. Each of the contacts 15 is slightly inwardly inclined so that the cup 13 is in the shape of a truncated cone. An annular fastening disc 16 comprised of synthetic insulating material is forced against the base 14 of the cup 13 and retains the cup 13 against the insulator ring 11 by a press fit.

The contacts 15 of the cup 13 engage the contact springs 5 with a selected spring pressure so as to not inhibit the short-circuit triggering of the fail-safe arrangement.

The second electrode of the auxiliary spark gap structure is formed by a plurality of projections 17 carried on the base 14 of the cup 13 which respectively extend a distance into the recesses 12. The discharge of the spark thus occurs between the flanged ring 10 and the highest elevation of the projections 17 within each recess 12. The spark gaps can thus be precisely dimensioned and the thickness of the insulator ring 11 may be increased without diminishing the proper operation of the spark gap. For example, the thickness of the insulator ring disc 11 may be four times the dimension of the spark gap, with the spark gap dimension being in the range of 0.1 mm. In a preferred embodiment, the projections 17 are hemispherical in shape.

Operation of the auxiliary spark gap structure is such that in the event that the surge arrester 7 is rendered inoperative, a surge voltage transmitted from the contact piece 2 through the contact cylinder 9 and the flanged ring 10 will discharge across the auxiliary spark gap, if of sufficient magnitude, to the projection 17 and be conducted to ground through the spring segments 15 in the cup 13 and the spring contacts 5 in the holder 3. The distance of the auxiliary spark gap is selected so that the surge voltage necessary to discharge across the gap is greater than the surge voltage which would normally melt the soft solder disc 6 when the surge arrester 7 is operating properly, so that normally voltage will discharge through the surge arrester 7 rather than discharge across the auxiliary spark gap.

Because all parts of the device are rigidly assembled, the tolerances of the auxiliary spark gap can be closely maintained so that the voltage necessary to discharge across the gap can be precisely determined.

Although modifications and changes may be suggested by those skilled in the art, it is the intention of the inventors to embody within the patent warranted hereon all changes and modifications as reasonably and properly come within the scope of their contribution to the art.

We claim as our invention:

1. In a device for protection of circuits against surge voltages having a surge arrester with two electrodes, a flanged ring electrically connected to one of said surge arrester electrodes forming a first electrode of an auxiliary spark gap, an insulating ring seated against and in axial registry with said flanged ring having a plurality of spaced apertures therein, and a conductive spring contact holder connected to the other electrode of said surge arrester and carrying a plurality of spring contacts, the improvement of an annular metal cup forming a second electrode of said auxiliary spark gap, said cup comprising:

a base seated against said insulating ring spaced from said first electrode;

an outside wall connected to said base and engaging said spring contacts; and a plurality of projections carried on said base aligned with and extending into said apertures in said insulating ring such that said auxiliary spark gap is less than the thickness of said insulating ring and such that discharge of a predetermined surge voltage magnitude occurs across said auxiliary spark gap within said apertures between said flanged ring and a highest elevation of said projections.

2. The improvement of claim 1 wherein said projections are hemispherical in shape.

3. The improvement of claim 1 wherein said surge arrester is connected to an external contact by a solid cylindrical contact and wherein said flanged ring, said insulator ring, and said annular cup surround said solid contact cylinder in axial alignment.

4. The improvement of claim 1 wherein the base of said annular metal cup is retained against said insulating ring by an annular fastening disc disposed in the interior of said cup.

5. The improvement of claim 4 wherein said annular fastening disc consists of insulating material and has a central aperture therein which receives said contact cylinder and secures said annular cup against said insulating ring by press fit.

6. The improvement of claim 1 wherein the number of apertures in said insulating ring is four and wherein said apertures are uniformly distributed on a circle and wherein the number of projections carried on said base of said annular cup is four.

7. The improvement of claim 1 wherein said wall of said annular cup is divided into a plurality of resilient contacts by a plurality of axial slots, said resilient contacts engaging said contact springs of said spring contact holder in tensioned relation.

8. The improvement of claim 7 wherein said resilient contacts extend inwardly of said cup such that said cup is in the shape of a truncated cone.

9. The improvement of claim 1 wherein said flanged ring is integrally connected to the one of said surge arrester electrodes at one face thereof and wherein said insulator ring is seated against an opposite face thereof.

10. The improvement of claim 1 wherein said surge arrester is a gas discharge surge arrester.

11. The improvement of claim 1 wherein said device further includes a cylindrical housing which receives said spring contact holder and wherein said contact springs are radially disposed on said spring contact holder for centering said holder in said housing.

12. The improvement of claim 1 wherein said surge arrester is received in said spring contact holder and wherein said annular metal cup is disposed for centering said surge arrester within said spring contact holder and wherein said annular metal cup further extends a radial distance for maintaining an interval between said spring contact holder and said surge arrester.

* * * * *